US005837927A

United States Patent [19]

Buenemann, Jr.

[11] Patent Number: 5,837,927

[45] Date of Patent: Nov. 17, 1998

[54] REVERSIBLE PELLET ORIENTING WAD FOR SHOTSHELL

[75] Inventor: Morris C. Buenemann, Jr., Florissant, Mo.

[73] Assignee: Olin Corporation, East Alton, Ill.

[21] Appl. No.: 13,340

[22] Filed: Jan. 26, 1998

Related U.S. Application Data

[62] Division of Ser. No. 798,081, Feb. 12, 1997.

[51] Int. Cl.[6] ..... F42B 7/08

[52] U.S. Cl. ..... 102/532; 102/448; 102/449

[58] Field of Search ..... 102/430, 439, 102/448–463, 520–523, 532

[56] References Cited

U.S. PATENT DOCUMENTS

| | | | |
|---|---|---|---|
| 295,235 | 3/1884 | Dennis | 102/532 |
| 1,742,817 | 1/1930 | Larson | 102/532 |
| 1,902,695 | 3/1933 | Edwards | 102/449 |
| 3,055,301 | 9/1962 | Miller et al. . | |
| 3,132,588 | 5/1964 | Schafer | 102/455 |
| 3,132,589 | 5/1964 | Schafer | 102/455 |
| 3,673,965 | 7/1972 | Herter | 102/451 |
| 3,786,753 | 1/1974 | Eckstein et al. . | |
| 4,479,438 | 10/1984 | Billsbury | 102/454 |
| 4,679,505 | 7/1987 | Reed | 102/449 |
| 4,815,388 | 3/1989 | Schluckebier et al. | 102/449 |
| 4,864,934 | 9/1989 | Theising | 102/430 |
| 5,347,932 | 9/1994 | Gardner et al. | 102/451 |
| 5,471,931 | 12/1995 | Gardner | 102/449 |

FOREIGN PATENT DOCUMENTS

| | | | |
|---|---|---|---|
| 1144008 | 10/1957 | France | 102/532 |
| 875201 | 10/1981 | Russian Federation | 102/458 |

*Primary Examiner*—Harold J. Tudor
*Attorney, Agent, or Firm*—Wiggin & Dana; Gregory S. Rosenblatt; Thomas F. Presson

[57] ABSTRACT

A pellet orienting member has a groove extending along a diameters of a disc for receiving a plurality of shot pellets of a first layer. The pellet orienting member may include at least one support surface adjacent to the first groove adapted to contact at least one shot pellet from a second layer. The pellet orienting member may have an additional, or second, groove on a second side extending along a second diameter. Either or both grooves may contain a separator in the groove. The groove may be of differing sizes and shapes, or may even be two depressions.

3 Claims, 5 Drawing Sheets

REVERSIBLE PELLET ORIENTING WAD FOR SHOTSHELL

CROSS-REFERENCE TO RELATED APPLICATION

This is a Division of application Ser. No. 08/798,081, which was filed on Feb. 12, 1997, and incorporated herein by reference in its entirety.

BACKGROUND OF THE INVENTION

1. Field of the Invention

This invention relates to decreasing the spread of shot pellets from a shotgun, more particularly this invention relates to decreasing the spread of shot pellets by placing the shot pellets in a particular orientation.

2. Brief Description of Relevant Art

Typically, shot pellets are closely packed with no particular orientation in a shotgun shell. When the shell is fired and the shot discharged into the barrel of the gun, the shot pass closely compacted through the barrel and are further compressed while passing through the choke of the barrel. These compressions mesh and mutilate the shot. The mutilated shot are less aerodynamically stable and scatter more than if they had not been mutilated.

Some patents disclose pellet orienting members to layer the shot in the shotshell casing. For example, U.S. Pat. No. 1,742,817 to Larson discloses a circular disk having a plurality of depressions only on a first side and each depression receives a shot pellet.

U.S. Pat. No. 3,132,589 to Schafer discloses means for orienting pellets of buckshot using two crescent shaped members placed on opposite sides of two shot pellets such that each layer in the shotshell consists of two shotshell pellets and two crescent shaped members. The members support the pellets in opposite diameters and position them so that they neither touch in the center nor abut the interior of the shotshell casing. The orienting members may include dimples to receive portions of the layer either above or below the current layer.

U.S. Pat. No. 4,679,505 to Reed discloses a thick walled sleeve within the shotshell casing to orient pairs of pellets such that each pair nests with an adjacent pair in a common nesting zone and none of the centers of the pellets are disposed within such a nesting zone. This patent discloses that the casing must have an effective internal diameter of less than 2.154 times the diameter of the 00 buckshot pellets (00 buckshot is approximately 0.33 inch in diameter). The pellets may also be stacked so that the two pellets of most of the pairs are slightly axially offset relative to each other and so that each pellet is arranged along one of a pair of separate varying helical paths about the casing.

U.S. Pat. No. 4,479,438 to Bilsbury discloses a saboted shot for maintaining the roundness of the shot pellets during launch and passage of the pellets through a smooth bore barrel. The sabot is a coaxial stack of at least two cylindrical wafers each dimpled to individually surround and protect the shot pellets.

What is needed is a pellet orienting member that is easily used and integrated into current manufacturing processes and techniques for shotshells that does not suffer from requiring multiple layers of pellet orienting members which require additional processing steps in the manufacturing of shotshells or require more accurate placement of the pellet orienting member in the manufacturing process.

SUMMARY OF THE INVENTION

Accordingly, the present invention is directed to a pellet orienting member that substantially obviates one or more of the problems due to limitations and disadvantages of the related art.

In accordance with the purpose of the invention, as embodied and broadly described, the invention includes a pellet orienting member having on a first side a first groove extending along a first diameter adapted to receive a plurality of shot pellets of a first layer. The pellet orienting member may include at least one support surface adjacent to the first groove adapted to contact at least one shot pellet from a second layer.

In another aspect of the invention, the pellet orienting member may have an additional, or second, groove on a second side extending along a second diameter.

In still another aspect of the invention, the pellet orienting member includes a separator in at least the first groove.

In still another embodiment, the pellet orienting member has two dimples, or indents, aligned along a first diameter. Each dimple, or indent, adapted to receive a shot pellet from a first layer. Two dimples, or indents, may be provided on a second side extending along a second diameter.

In still another embodiment, the pellet orienting member has a plurality of stepped concentric support surfaces.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description, serve to explain the principles of the invention.

DETAILED DESCRIPTION OF THE INVENTION

Figure 1:
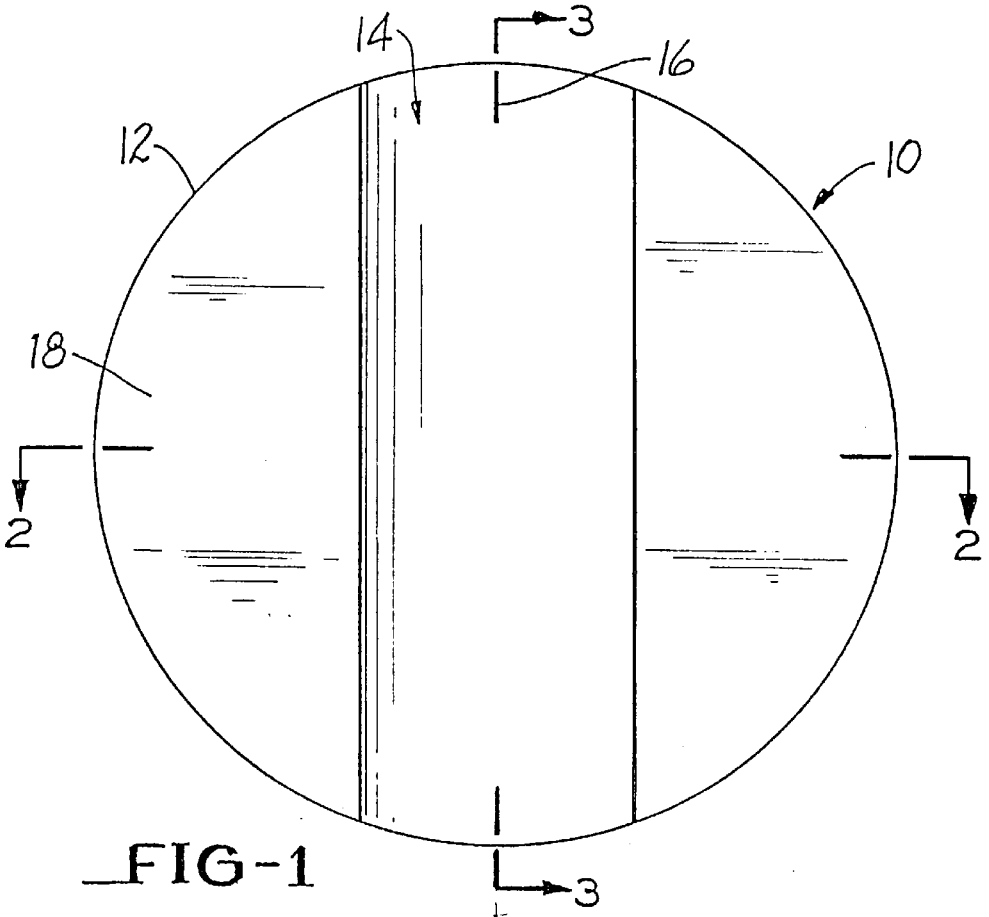
FIG. 1 is a top plan view of the pellet orienting member according to a preferred embodiment of the present invention.

Reference will now be made in detail to the present preferred embodiments of the invention, examples of which are illustrated in the accompanying drawings, where like or similar parts are identified by the same reference characters.

The exemplary embodiment of the pellet orienting member of the present invention is shown in a top plan view in FIG. 1 and is designated generally by the reference numeral 10.

As embodied herein and referring to FIG. 1, pellet orienting member 10 includes a wad 12, having a groove 14 extending along a diameter 16 of wad 12 on a first side 18 of wad 12.

The wad 12 is preferably circular in shape and approximately plus or minus 0.005 inch of the internal diameter of a shotshell casing to be used in combination with the wad 12. More preferably, the wad has a diameter just slightly less than the internal diameter of the shotshell casing it is to be placed in. The invention is equally applicable for any size shotshell casing, but is described for simplicity for a typical 12-gauge shotgun casing having an internal diameter of from about approximately 0.725 inch to about 0.750 inch. The invention is preferably envisioned to work with shotshell casings of the Reifenhauser type having an exemplary internal diameter from about 0.740 inch to about 0.748 inch and of the paper type having an exemplary internal diameter from about 0.725 inch to about 0.730 inch.

Figure 2:
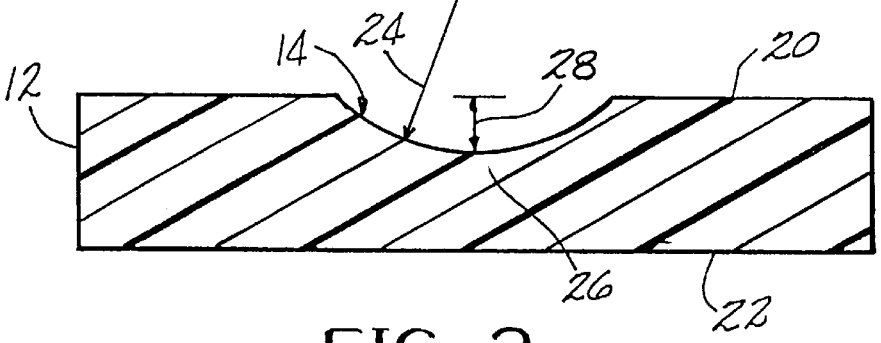
FIG. 2 is a cross-sectional view of the pellet orienting member of FIG. 1.

FIG. 2 illustrates a cross-sectional view of the wad 12 along the line A-A' of FIG. 1. A first surface 20 of wad 12 is separated from a second surface 22. The distance between first surface 20 and second surface 22 is chosen to provide structural integrity of the wad 12 and depends on the particular embodiment. The preferred distances between first surface 20 and second surface 22 are described below. In an illustrative embodiment, the first surface 20 is preferably about 0.313 inch from a second surface 22.

The wad 12 is preferably made from a material softer than typical shot. Typical shot pellets are lead, lead/antimony, steel, bismuth, or tungsten/polymer matrix. For example, the wad 12 may be plastic, for example, polyethylene, or silicone rubber. Alternatively, the wad 12 may be molded fiber, cardboard, or any material softer than the type of shot pellet used so that the wad 12 deforms more easily than the shot pellets.

In one embodiment, a groove 14 extends along a radial diameter 16, as illustrated in FIG. 1. The groove 14 extends from one side of wad 12 to the other. As illustrated in FIG. 2 along the line A-A', groove 14 is preferably arcuate in shape. The groove 14 could also be other type of shapes including v-shaped, unshaped, or square-u-shaped. Preferably, the groove 14 has a radius of curvature 24 as measured from a point transverse and above the diameter 16 into first surface 20. The radius of curvature 24 may be slightly less than the radius of curvature of the type of shot pellet used, but is more prefered as at least equal to the radius of curvature of the type of shot pellet used. Any type of shot pellet is equally preferred. By way of example, the radius of curvature 24 when the wad 12 is used with a 00 shot pellet is from about 0.1 inch to about 0.25 inch. More preferably, the radius of curvature 24 is from about 0.12 inch to about 0.23 inch. Most preferred, the radius of curvature 24 is from about 0.14 inch to about 0.22 inch. In an illustrative embodiment, the groove 14 has a radius of curvature 24 of about 0.188 inch.

A lowermost portion 26 of groove 14 extends a distance 28 into wad 12 from about 0.005 inch to about 0.2 inch, more preferably, the distance 28 is from about 0.008 inch to about 0.18 inch. In an illustrative embodiment, the distance 28 is about 0.125 inch. Equally preferred, the distance 28 may be as described below.

Figure 3:
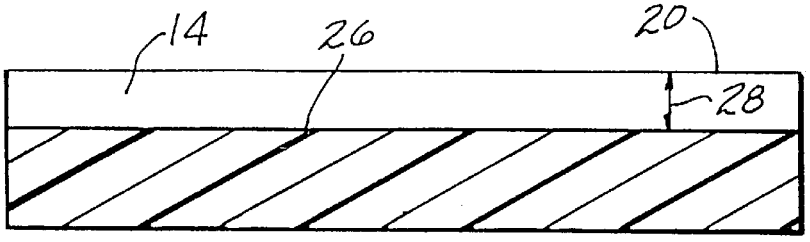
FIG. 3 is a side view cut away of a pellet orienting member according to a preferred embodiment of the invention.

FIG. 3 illustrates a preferred embodiment of groove 14 along a line 3—3 of FIG. 1 wherein the lowermost portion 26 of the groove 14 is a constant distance 28 from the first surface 20 across diameter 16.

Figure 4:
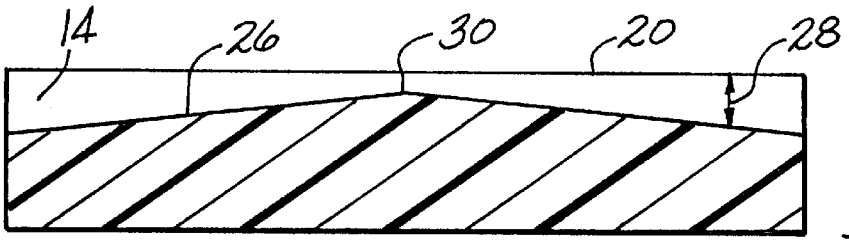
FIG. 4 is a side view cut away of a pellet orienting member according to another preferred embodiment of the invention.

FIG. 4 illustrates an equally preferred embodiment of groove 14 along a line 3—3 of FIG. 1 wherein the lowermost portion 26 of the groove 14 has a varying distance 28 from the first surface 20.

The distance 28 decreases from the edges of the groove 14 to a midpoint 30 of diameter 16, where the distance 28 from the first surface 20 is a minimum. The maximum of the distance 28 in this embodiment is similar to distance 28 described herein.

Figure 5:
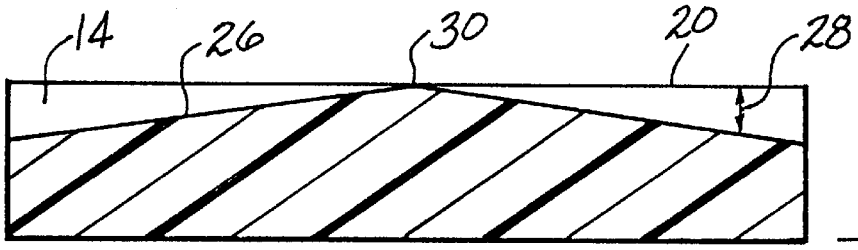
FIGS. 5 through 7 are side view cut away views of a pellet orienting member according to still other preferred embodiments of the invention.

FIG. 5 illustrates another equally preferred embodiment of the groove 14 along a line 3—3 of FIG. 1, wherein the distance 28 at the midpoint 30 decreases to zero.

Figure 6:
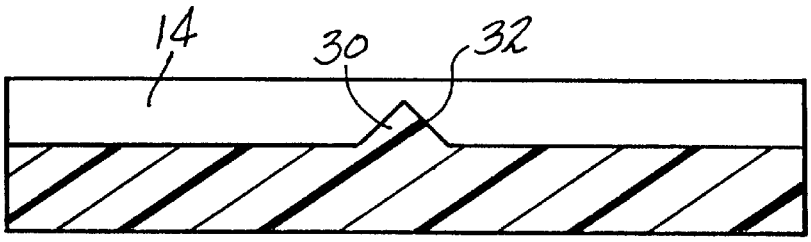

FIG. 6 illustrates still another equally preferred embodiment of the groove 14 along a line 3—3 of FIG. 1 wherein a separator 32 is located at the midpoint 30. The separator 32 may be may various shapes including bump, semicircular, or triangular. FIG. 6 provides a exemplary triangular shaped separator 32. The actual size of separator 32 depends on it usage. The separator 32 may be used to position the lower layer of pellets without the presence of the upper layers to aid in the pellet orientation when pellets are added to the shotshell casing, either in pairs or in total.

Figure 7:
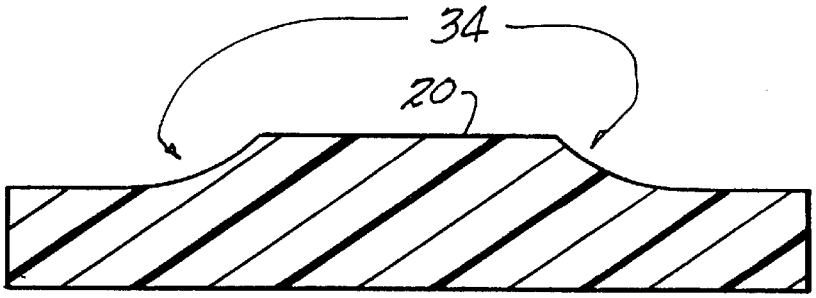
Figure 8:
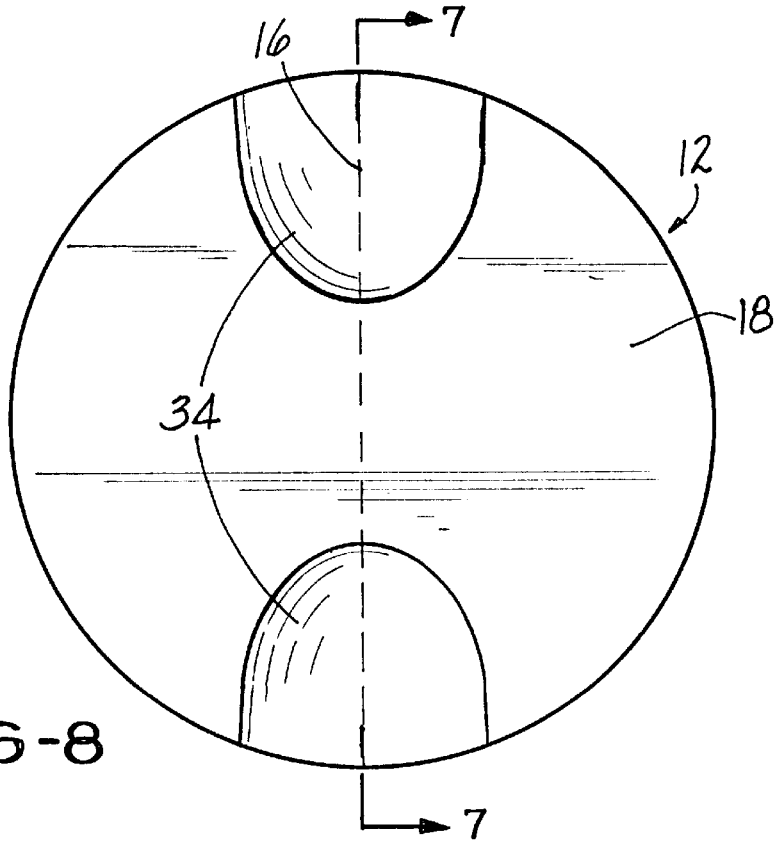
FIG. 8 is a top plan view of the pellet orienting member of FIG. 7.

FIG. 7 illustrates a cross section along the diameter 16 of still another, equally, preferred embodiment of the invention along a line 3—3 of FIG. 1. This embodiment includes two depressions 34 located at opposite ends of the diameter 16. Each of the depressions 34 is a curved shaped depression extending into the first surface 20. FIG. 8 illustrates this embodiment looking above the first surface 20. In this embodiment, each depression is at least about 1 pellet diameter in length with a radius of curvature at least equal to about that of the pellet. Any type of pellet is preferred.

Equally preferred for all of the embodiments discussed above, and referring to FIG. 9, a corresponding groove 15 or depressions (not shown) is located in the second surface of wad 12 along a radial diameter 37. In this embodiment, the corresponding groove 15 or depressions are located along an axis transverse and substantially perpendicular to the groove 14 or depressions in the first surface 20. For example, FIG. 9 illustrates the wad 12 viewed toward the first side 18 and indicates the groove 15 in the second side as dotted lines 36.

Figure 9:
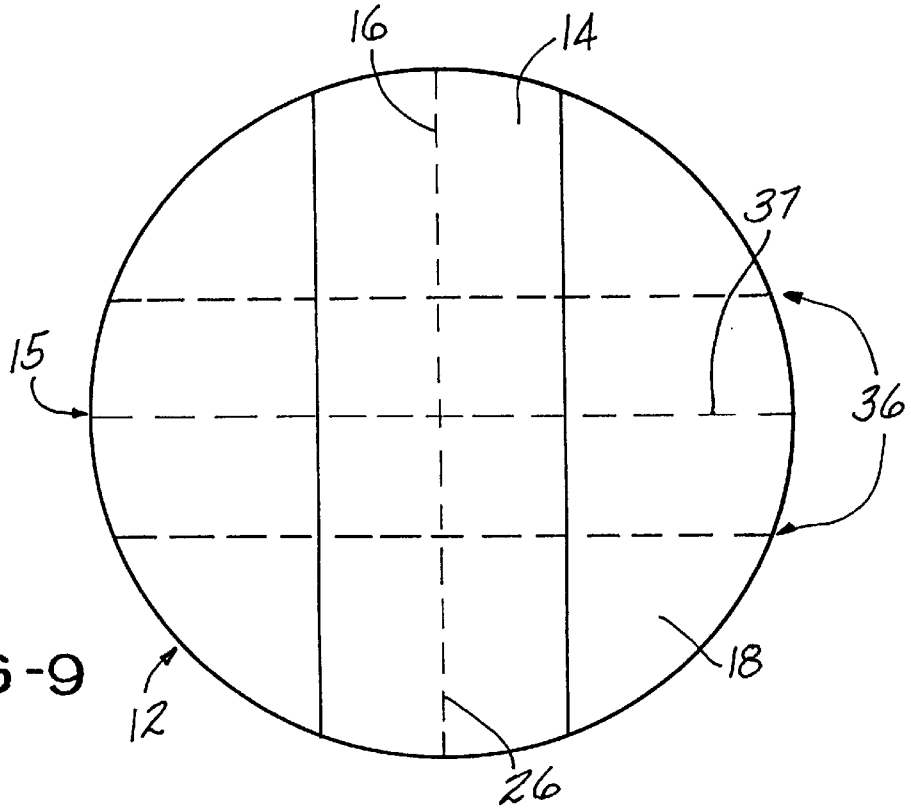
FIG. 9 illustrates a top plan view showing still another embodiment of the invention.

The embodiment of FIG. 9 provides for ease of loading by eliminating the need for any particular orientation of the pellet orienting member 10 in the shotshell casing. Furthermore, the embodiment of FIG. 9 decreases the material requirements for the manufacture of the pellet orienting member 10 while maintaining its structural integrity. The lowermost portion 26 of groove 14 or depressions in the opposing surfaces are offset by an appropriate amount from the lower portions of corresponding grooves 15 and depressions as well as the angle between the diameter 16 and the diameter 37. For example, one preferred amount for the angle between the diameters 16 and 37 is from about 80° to 90°, more preferred is from about 87° to 90°, and most preferred is about 90° for the two-per-layer orientation. This increases material thickness in the pellet support areas, while reducing the thickness of the part and its weight.

Referring back to FIG. 2, the distance between first surface 20 and second surface 22 depends on the embodiment. For example, an embodiment including a groove 14 on one side only needs to provide support from allowing the lowermost layer of pellets from piercing the lower surface 26. In an illustrative example, the distance between surfaces 20 and 22 is equal to 0.125 inch beyond the distance 28, the distance 28 at 0.125 inch, so that the distance between surfaces 20 and 22 is about 0.25 inch.

In another example, wherein the wad 12 includes opposing grooves 14 and 15. With each groove about 0.125 inch, a suitable distance between the two grooves is about 0.125 inch, so that the distance between the surfaces 20 and 22 is about 0.375 inch.

Figure 10:
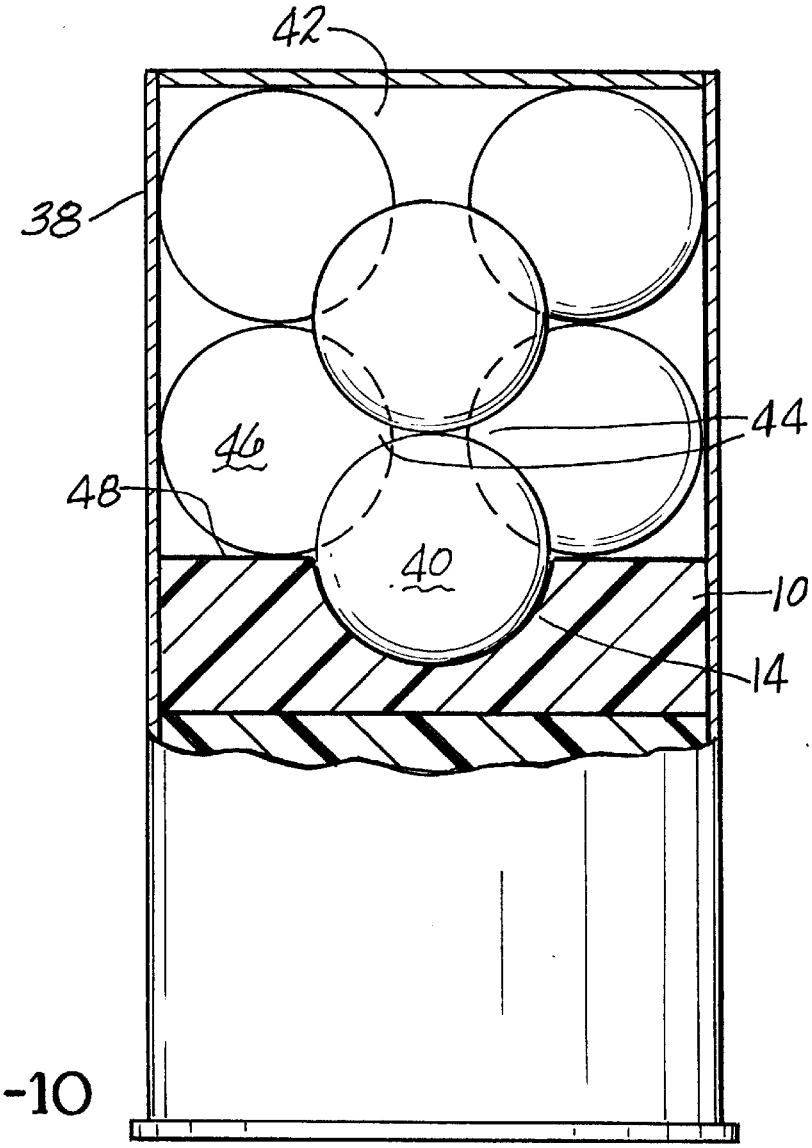
FIG. 10 illustrates a shotshell containing a pellet orienting member according to the present invention.

As illustrated in FIG. 10, the pellet orienting member 10 fits inside a shotshell casing 38 and provides support for a first layer 40 of shot pellets 42 and a second layer 46 of shot pellets 42.

In a preferred embodiment, shot pellets 42, making up the shot layers, are 00 buck, that is about 0.33 inch in diameter.

In a typical 12 gauge shotshell having an internal diameter of approximately 0.725 inch to approximately 0.750 inch, the shot pellets 42 naturally rest in a three-per-layer configuration. By placing the shot pellets 42 in a two-per-layer configuration, dispersion levels may be reduced.

Figure 11:
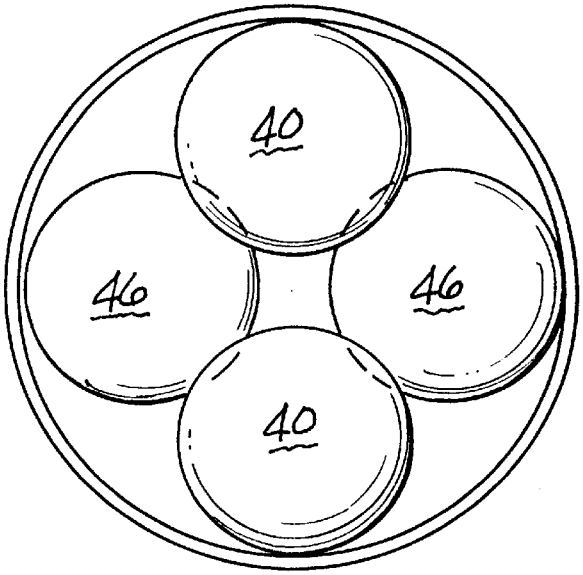
FIG. 11 illustrates a top view of the shotshell illustrated in FIG. 10.

The two-per-layer configuration decreases the number of pellet-to-pellet contact points, which usually provide deformation sites for the shot pellets 42, resulting from the set back forces of firing. FIGS. 10 and 11 illustrates the contact points 44 between first layer of shot pellets 40 and the second layer 46. The pellets of the first shot layer each contact the groove 14, the internal diameter of the shotshell casing and both pellets of the second layer. Each of the pellets of the second layer contact the two pellets of the lower layer, the internal diameter of the shotshell casing and the two pellets of the layer above the second layer, is present. In the two-per-layer configuration, the pellet column is generally elongated along the length of the gun barrel. The elongated column generally reduces the total amount of deformation experienced by the shot column by having a greater quantity of shot absorbing buffer.

Contouring the groove 14 in the wad 12 for the first layer of shot pellets 40 to generally match their shape provides more supporting surface area for the first layer of shot pellets 40, and thus, reduce the amount of deformation to that layer as compared to flat support surfaces.

In another preferred embodiment, the wad has a further advantage of providing support for both the bottom layer of shot and the second layer of shot as illustrated in FIG. 10. The second layer of shot is supported by a support surface 48 adjacent to the groove 14 or depressions 34 of the previous Figs. This second layer support via support surface 48 more evenly distributes the load of the upper layers of shot, further reducing the deformation on the bottom layer.

In this embodiment, the distance 28 of FIG. 2 is preferably at least that given by the following equation:

$$\text{distance } 28 = d\sqrt{1 - \frac{1}{2}\left(\frac{D-d}{d}\right)^2}$$

where D=the internal diameter of the shotshell casing; d=the diameter of the pellet. For an exemplary D=0.745 inch and d=0.33 inch, the distance 28 is at least 0.151 inch. This distance is the point where the pellets of the second layer are in equal contact with the two pellets of the first layer the surface 20 and the internal diameter surface of the shotshell casing.

Alternately, the distance 28 may be slightly less than that given by the above equation. When the distance 28 is given by the above equation, the second layer is provided support, but when the distance 28 is slightly less than that given by the above equation, the pellets in the second layer contact with the pellets of the first layer and the internal diameter of the shotshell casing, while not touching the support surface 48. Upon discharge, the pellets are slightly deformed as they are compacted toward the wad 12. Accordingly, distances less than those given by the above equation are less preferred because they tend to result in more deformed pellets.

Typically, an n-per-layer configuration within a shotshell casing follows from the following equation:

$$\text{minimum } ID = d\left(1 + \frac{1}{\sin\left(\frac{\pi}{n}\right)}\right)$$

where "minimum ID" represents the minimum internal diameter of the shotshell casing, d=the diameter of the pellets, and n=the number of pellets in the layer. Therefore, the equation for an internal diameter (ID) for an n-per-layer configuration is given by:

$$d\left(1 + \frac{1}{\sin\left(\frac{\pi}{n}\right)}\right) = ID < d\left(1 + \frac{1}{\sin\left(\frac{\pi}{n+1}\right)}\right)$$

A two-per-layer configuration for a typical 00 buckshot having a d=0.33 inch requires a shotshell casing having a diameter no less than 0.66 inch and less than 0.711 inch, thus smaller than the typical 0.724 inch to 0.750 inch diameter of a typical shotshell casing 38. This reduced diameter forces the 0.33 inch diameter pellets into the two-per-layer configuration. However, this requires either the use of a thick walled cup, a sleeve member within a conventional shotshell casing 38, or other artificial reduction in the internal diameter of a typical 12 gauge tube. Furthermore, any such loading would only support the bottom layer of shot, not the two layers as does the present invention according to some of the embodiments.

Figure 12:
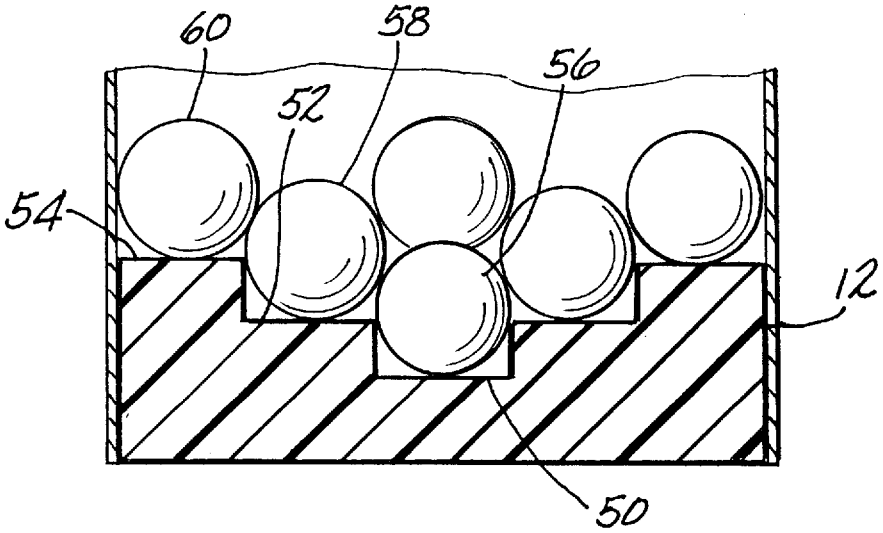
FIG. 12 illustrates a side view of a pellet orienting member according to another embodiment of the present invention.

In still another embodiment, support is provided for more then one layer of shot by wad 12. As illustrated in a side cut away view in FIG. 12, the wad 12 includes first support surface 50, second support surface 52, and third support surface 54. The first support surface 50 supports a lowermost layer of pellets 56 as illustrated. The second support surface 52 supports a second layer of pellets 58, and the third support surface 54 supports a third layer of pellets 60. The three support surfaces are stepped upward and outward from the center of the wad 12.

Figure 13:
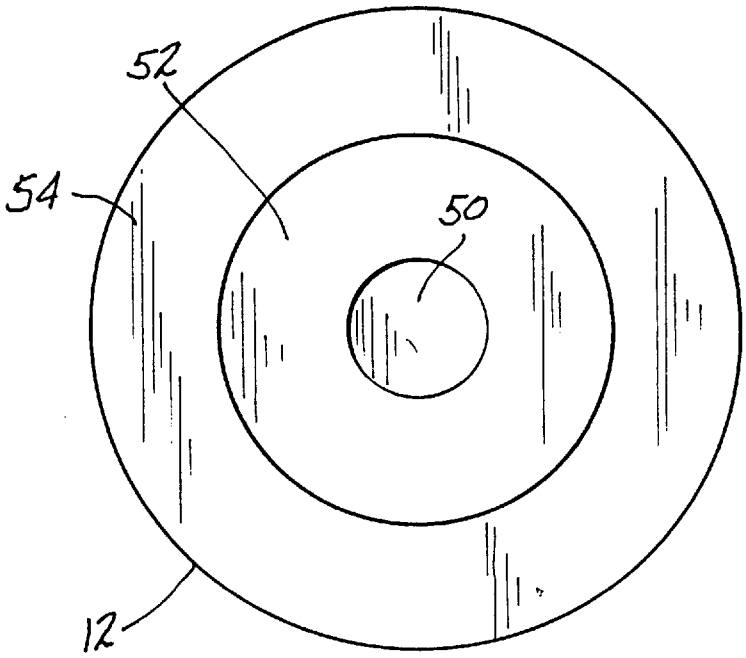
FIG. 13 illustrates a top plan view of the pellet orienting member of FIG. 12.

FIG. 13 provides a view looking down on the wad 12. The three support surfaces form concentric circles as viewed from this angle.

The surfaces of the three support surfaces may be flat or grooved. If grooved, the grooves will have shapes conforming to the grooves 14 as described earlier.

Although illustrated as a wad 12 with three support surfaces, it is equally preferred to have more than three. The number of support surfaces depends on the relative sizes of the shotshell casing and the shot.

It will be apparent to those skilled in the art that various modifications and variations can be made in the pellet orienting member of the present invention without departing from the spirit or scope of the invention. Thus, it is intended that the present invention cover the modifications and variations of this invention provided they come within the scope of the appended claims and their equivalents.

What is claimed is:

1. A pellet orienting member having on a first side thereof a first groove arcuate in shape for supporting a first layer of shot pellets extending entirely across a first radial diameter with a radius of curvature at least equal to a radius of curvature of one shot pellet of said plurality of shot pellets; and having a second groove on a second side thereof extending along a second diameter.

2. The pellet orienting member as claimed in claim 1, wherein the first radial diameter is substantially perpendicular to the second diameter.

3. The pellet orienting member as claimed in claim 1 further including a separator in at least the first radial groove.

* * * * *